US007918920B2

(12) United States Patent
De John

(10) Patent No.: US 7,918,920 B2
(45) Date of Patent: Apr. 5, 2011

(54) ASSEMBLY AND PROCESS FOR IMPROVING COMBUSTION EMISSIONS OF A COMBUSTION APPARATUS

(76) Inventor: David De John, Oak Forest, IL (US)

( * ) Notice: Subject to any disclaimer, the term of this patent is extended or adjusted under 35 U.S.C. 154(b) by 290 days.

(21) Appl. No.: 11/952,749

(22) Filed: Dec. 7, 2007

(65) Prior Publication Data

US 2009/0084262 A1 Apr. 2, 2009

Related U.S. Application Data

(60) Provisional application No. 60/976,561, filed on Oct. 1, 2007.

(51) Int. Cl.
*B03C 1/14* (2006.01)

(52) U.S. Cl. ..... 95/28; 96/1; 123/538; 210/222; 210/695

(58) Field of Classification Search ..... 95/28; 96/1, 96/2; 123/538; 210/222, 223, 695
See application file for complete search history.

(56) References Cited

U.S. PATENT DOCUMENTS

| | | | |
|---|---|---|---|
| 3,830,621 | A | 8/1974 | Miller |
| 4,265,755 | A | 5/1981 | Zimmerman |
| 4,367,143 | A | 1/1983 | Carpenter |
| 4,414,951 | A | 11/1983 | Saneto |
| 4,538,582 | A | 9/1985 | Wakuta |
| 4,572,145 | A | 2/1986 | Mitchell et al. |
| 4,711,271 | A | 12/1987 | Weisenbarger et al. |
| 4,933,151 | A | 6/1990 | Song |
| 5,129,382 | A | 7/1992 | Stamps, Sr. et al. |
| 5,238,558 | A | 8/1993 | Curtis |
| 5,271,369 | A | 12/1993 | Melendrez |
| 5,331,807 | A | 7/1994 | Hricak |
| 5,439,204 | A | 8/1995 | Yamazoe et al. |
| 5,558,765 | A | 9/1996 | Twardzik |
| 5,664,546 | A | 9/1997 | De La Torre Barreiro |
| 5,816,226 | A | 10/1998 | Jernigan et al. |

(Continued)

FOREIGN PATENT DOCUMENTS

CA 2361730 4/2003

(Continued)

OTHER PUBLICATIONS www.terrapass.com/road/products (2005) Ford Taurus; Subaru Legacy; Volkswagen Jetta Nissan Maxima; Chrysler Sebring print-outs from website.

(Continued)

*Primary Examiner* — Richard L Chiesa
(74) *Attorney, Agent, or Firm* — Howard B. Rockman

(57) ABSTRACT

The present invention provides an assembly for reducing combustion emissions of a combustion apparatus having a combustion chamber producing combustion. The combustion apparatus also has a fluid passageway for carrying treated fluid to the combustion chamber. The assembly includes at least one magnet positioned such that a north pole of each magnet is adjacent the fluid passageway, and a south pole of each magnet is on an opposite side of the north pole and positioned away from the fluid passageway. Each magnet is capable of operating at a sustained efficiency at operating temperatures of approximately 302° F. Each magnet provides a residual flux density of at least approximately 10,000 gauss. The combustion emissions have at least approximately a 1.5% reduction in carbon dioxide emissions compared to the combustion of untreated fluid, as well as reductions in hydrocarbon and carbon monoxide emissions.

18 Claims, 3 Drawing Sheets

U.S. PATENT DOCUMENTS

| | | | | |
|---|---|---|---|---|
| 5,918,636 | A | 7/1999 | Mitchell et al. | |
| 6,056,872 | A | 5/2000 | Glass | |
| 6,158,421 | A | 12/2000 | Hsieh et al. | |
| 6,596,163 | B1 | 7/2003 | Parker | |
| 6,849,188 | B2 * | 2/2005 | Sacs | 210/695 |
| 6,851,413 | B1 | 2/2005 | Tamol, Sr. | |
| 6,890,432 | B1 | 5/2005 | Witz et al. | |
| 6,901,917 | B2 | 6/2005 | Muller | |
| 2003/0101973 | A1 | 6/2003 | Hricak | |
| 2003/0140903 | A1 | 7/2003 | Smoot | |
| 2003/0183207 | A1 * | 10/2003 | Muller | 123/538 |
| 2005/0076889 | A1 | 4/2005 | Melendrez | |
| 2006/0231049 | A1 | 10/2006 | Luercho | |
| 2007/0071611 | A1 | 3/2007 | Martin | |

FOREIGN PATENT DOCUMENTS

| | | | | |
|---|---|---|---|---|
| GB | 2261834 | A | | 6/1993 |
| JP | 2-161163 | A | * | 6/1990 |
| WO | WO2006123224 | A2 | | 11/2006 |

OTHER PUBLICATIONS www.tinet.org Magnetic FuelSaver, other FuelSavers and Fuel Optimizers printout from website (9 pages), Aug. 30, 2007.

www.ftc.gov/bcp/conline/pubs/autos/gasave.shtm Facts For Consumers "Gas-Saving" Products: Fact or Fuelishness (5 pages) printout from website, Jul. 8, 2007.

http://abclocal.go.com/wjrt Gas Magnets: How Well Do They Work? (3 pages) printout from website, Jul. 8, 2007.

http://www.wondermagnet.com "Do-It-Yourself Magnetic Water Treatment" (9 pgs.) from website, Jul. 8, 2007.

http://autobloggreen.com/2006 "Erin Brockovich Gets Your Attention, But Can Magnets Improve Fuel Economy" by Mike Magda (12 pages).

http://www.rand.org/news/press Jul. 5, 2003 Rand Says Further Study Warranted On Save The World Air Technology (2 pages).

2007 The Little Green Data Book, by the International Bank for Reconstruction and Development/The World Bank Apr. 27, 2007 (240 pages).

Technical Report "An Approach to Assessing The Technical Feasibility and Market Potential Of A New Automotive Device" RAND Zero Emission Fuel Saver Study Team (7 pages), Jul. 8, 2007.

http://www.magnetizer.net/banner.htm Magnetizer (3 pages), Jul. 8, 2007.

http:// clearwatergmx.com Clearwater GMS The Chemical Free Solution (7 pages) print out from website, Jul. 8, 2007.

http://www.moremiles4u.com Want Better Gas Mileage? Desire Reduced Emissions? Crave Enhanced Performance? (6 pages), Jul. 8, 2007.

http://www.tradekey.com/product Ningbo Mingrui Magnetic materials Co., Ltd. (3 pages) print out from website, Jul. 8, 2007.

http://wg.auctions Fuel Magnets on Sale Yahoo Autctions Singapore (3 pages), Jul. 8, 2007.

http://www.ecomagnets.com ECOFLOW Magnetic Water Conditioner (2 pages) printout from website Jul. 8, 2007.

www.freepatentsonline.com search results.

* cited by examiner

ASSEMBLY AND PROCESS FOR IMPROVING COMBUSTION EMISSIONS OF A COMBUSTION APPARATUS

RELATED APPLICATIONS

This application claims priority to and incorporates herein by reference the application and exhibits of U.S. Provisional Application Ser. No. 60/976,561, filed Oct. 1, 2007.

BACKGROUND OF THE INVENTION

Improvement trends in fuel economy and auto emissions reductions, if any, have paled in comparison to the dramatic increase in the number of new and used vehicles on the road. According to the National Automobile Dealers Association (NADA), the total number of cars on the road increased in 2005 to over 238 million, up from 198 million in 1996. http://www.nada.org/NR/rdonlyres/93F45723-C66F-4437-BEAB-8F523221C8BA/0/NADA DATA 2007 Vehicles Operation Scrappage.pdf (accessed Sep. 19, 2007). This dramatic increase translates to 16.8% more driven vehicles that inevitably produce more harmful greenhouse gas emissions on any given day.

Individually, the world's auto manufacturers have made only questionable progress in contributing to the reduction of global warming emissions, even over a ten-year period. In 1996, a 1996 Ford Taurus driven 12,000 miles produced approximately 9,586 pounds of carbon dioxide a year. In comparison, a 2005 Ford Taurus driven 12,000 miles produced approximately 9,997 pounds of carbon dioxide a year. Terrapass.com, http://www.terrapass.com/road/carboncalc.php?yearselect=1995 (accessed Sep. 18, 2007). The net result over the ten-year period is not a decrease but an increase of carbon dioxide emissions, by approximately 4.1%. Comparing other known automobile makes and models, a Nissan Maxima produced approximately 9,586 and 9,782 pounds of carbon dioxide in 1996 and 2005, respectively, whereas a Volkswagen Jetta produced approximately 9,391 and 9,215 pounds of carbon dioxide in 1996 and 2005, respectively. This means that over a ten-year period, given the 1996 and 2005 model years, the Nissan Maxima actually increased its carbon dioxide emissions by 2.0%, while the Volkswagen Jetta decreased its carbon dioxide emissions by just 1.9%. Sampling makes and models from other auto manufacturers given the same 1996 and 2005 model years, the Chrysler Sebring and Toyota 4-Runner each actually increased their carbon dioxide emissions by approximately 3.9% and 7.4%, respectively, while the Subaru Legacy reduced its carbon dioxide emissions, but only by approximately 1.3%. Collectively, even over a ten-year period, auto manufacturers appear to have accomplished little in contributing to the net reduction of harmful global warming emissions.

The problem with auto manufacturers' erratic success in reducing combustion emissions over time is that drivers have substantially increased the use of their vehicles in their daily lives. According to a U.S. Department of Transportation press release, Americans drove nearly three trillion miles on United States highways in 2005. This figure—2,989,807,000,000 miles traveled—represents a 27.4 billion mile increase in travel over 2004. Over a twelve-year period from 1994 to 2005, this translates into about a 25 percent increase in miles traveled. Highway Statistics 2005, US Department of Transportation, Federal Highway Administration, http://www.fhwa.dot.gov/policy/ohpi/hss/hsspubs.htm (accessed Sep. 18, 2007). Thus, the net impact on the global greenhouse effect is a significant increase of harmful gas emissions.

Given that even a ten-year period has brought little or no benefit to the reduction of harmful global emissions, there is an urgent need for an apparatus that can be fitted on environmentally unfriendly vehicles already in use to provide an instant emissions reduction of at least 1.5%. As the inevitable scarcity of refined fuels continues to impact our global economy and environment, and as experts continue to correlate emissions reduction performance with improved fuel economy, there is clearly a need for an assembly and process that can significantly improve combustion engine emissions.

SUMMARY

An assembly and process for improving the combustion emissions of an internal combustion engine are disclosed herein. One exemplary embodiment of the present invention securely clamps the assembly directly to the exterior of a feeding fuel line. In another exemplary embodiment, the assembly is comprised of a neodymium (NdFeB) magnet that is secured in a plastic housing. The housing secures the magnet and is positioned such that the north pole of the magnet is adjacent to the fuel line, while the south pole of the magnet is opposite the north pole. In this exemplary embodiment, the housing is connected to a backing plate, whereby the fuel line passes between the north-pole side of the housing and the backing plate to provide the fuel line with a positively charged magnetic field.

BRIEF DESCRIPTION OF THE DRAWINGS

While the accompanying claims of the exemplary embodiments of the invention set forth features of an assembly and process for reducing the combustion emissions of an internal combustion engine disclosed herein with particularity, the assembly and process may be best understood from the following detailed description taken in conjunction with the accompanying drawings, of which:

EXEMPLARY EMBODIMENTS OF THE ILLUSTRATED INVENTION

Figure 2A:
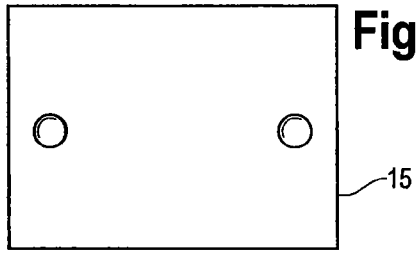
FIG. 2A illustrates a top view of a backing plate according to an exemplary embodiment of the invention disclosed herein.
Figure 1:
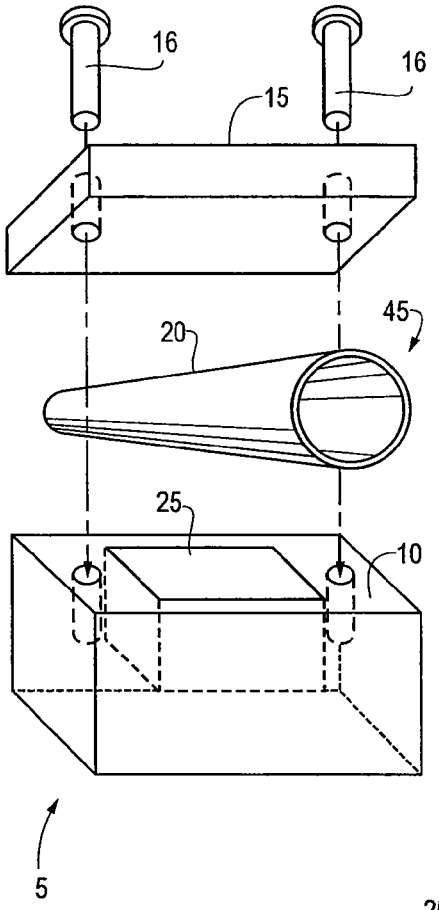
FIG. 1 illustrates a perspective view of an exemplary embodiment of the invention disclosed herein.
Figure 2B:
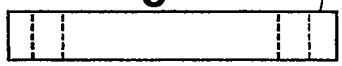
FIGS. 2B and 2C are a front view and a side view, respectively, of the backing plate shown in FIG. 2A.
Figure 2C:
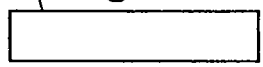
Figure 1A:
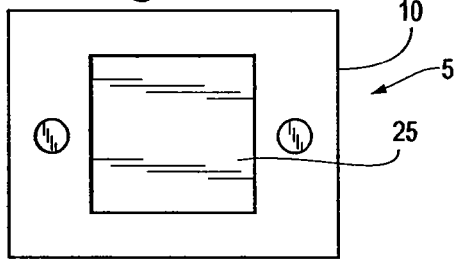
FIG. 1A illustrates a top view of a housing according to an exemplary embodiment of the invention disclosed herein.
Figure 1B:
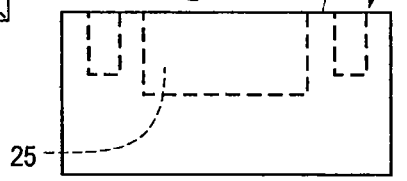
FIG. 1B illustrates a front view of the housing of FIG. 1A according to an exemplary embodiment of the invention disclosed herein.
Figure 1C:
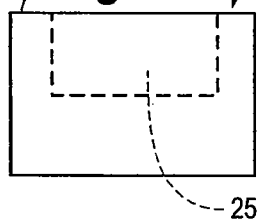
FIG. 1C illustrates a side view of the housing of FIG. 1A according to an exemplary embodiment of the invention disclosed herein.
Figure 3:
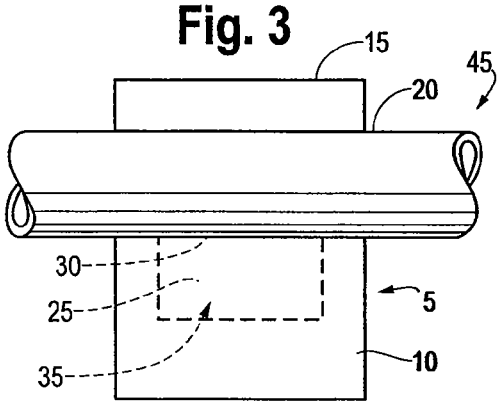
FIG. 3 illustrates a side view of an assembly attached to a fuel line according to an exemplary embodiment of the invention disclosed herein.
Figure 4:
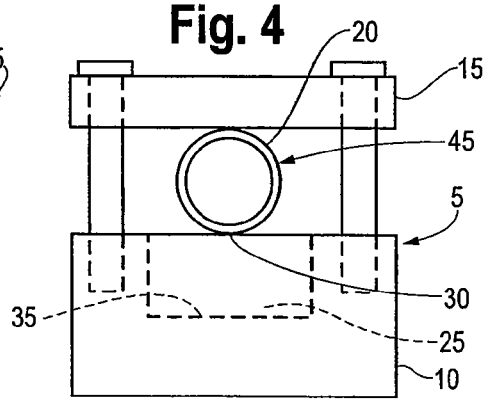
FIG. 4 illustrates a front view of the assembly attached to the fuel line according to an exemplary embodiment of the invention disclosed herein.
Figure 5:
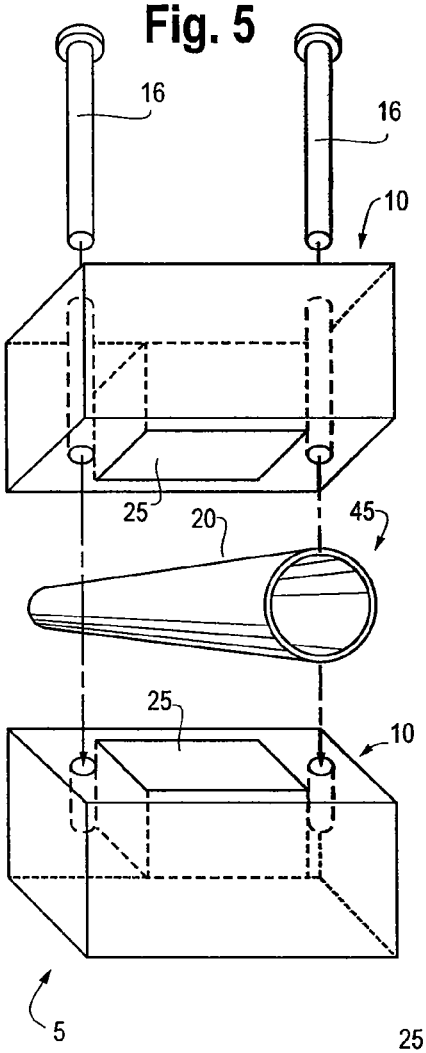
FIG. 5 illustrates a perspective view of an exemplary embodiment of the invention disclosed herein.
Figure 5A:
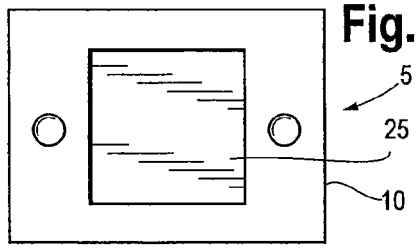
FIG. 5A illustrates a top view of a first housing according to an exemplary embodiment of the invention disclosed herein.
Figure 5B:
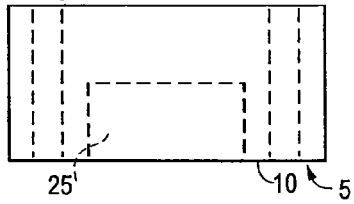
FIG. 5B illustrates a front view of the first housing according to an exemplary embodiment of the invention disclosed herein.
Figure 5C:
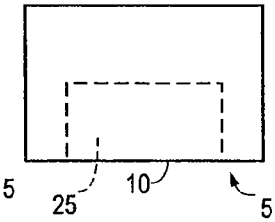
FIG. 5C illustrates a side view of the first housing according to an exemplary embodiment of the invention disclosed herein.
Figure 6A:
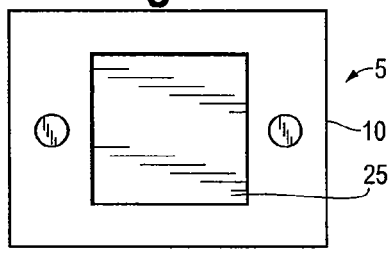
FIG. 6A illustrates a top view of a second housing according to an exemplary embodiment of the invention disclosed herein.
Figure 6B:
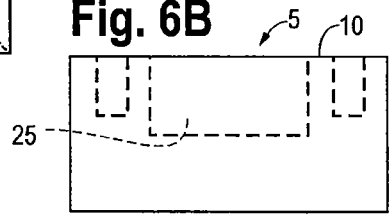
FIG. 6B illustrates a front view of the second housing according to an exemplary embodiment of the invention disclosed herein.
Figure 6C:
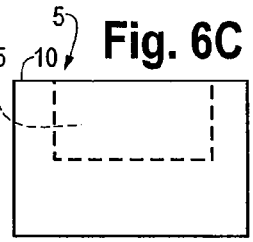
FIG. 6C illustrates a side view of the second housing according to an exemplary embodiment of the invention disclosed herein.
Figure 7:
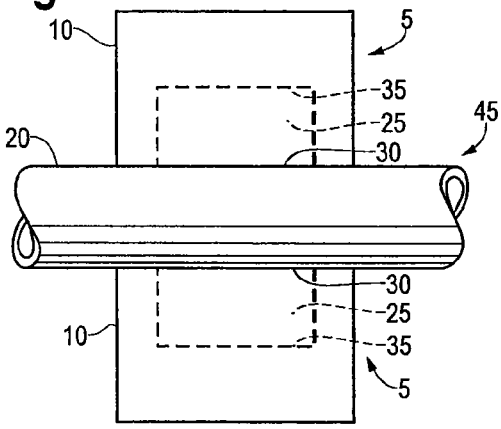
FIG. 7 illustrates a side view of an assembly comprising the first housing and the second housing attached to a fuel line according to an exemplary embodiment of the invention disclosed herein.
Figure 8:
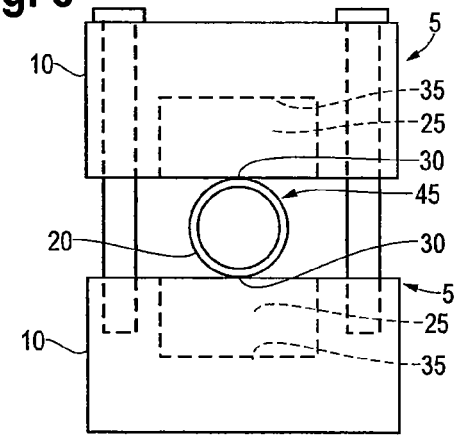
FIG. 8 illustrates a front view of the assembly comprising the first housing and the second housing attached to the fuel line according to an exemplary embodiment of the invention disclosed herein.

The following detailed description is not intended to be limiting in any sense but rather is made solely for the purpose of illustrating the general principles of exemplary embodiments of the invention. The scope of the invention is to be determined by the appended claims Several exemplary embodiments are depicted in FIGS. 1-15. Each exemplary embodiment requires at least one magnet 25 positioned such that a north pole 30 of each magnet 25 is adjacent a fluid passageway 45 and a south pole 35 of each magnet 25 is on an opposite side of the north pole 30 from the fluid passageway 45, each magnet 25 is capable of operating at a sustained efficiency at operating temperature of approximately 302° F. Exemplary embodiments further include at least one mechanism for maintaining the position of each magnet 25 relative to the fluid passageway 45; and, at least one housing 10 supporting each magnet 25. Each is constructed to permit the associated magnet 25 to provide a residual flux density of at least approximately 10,000 gauss.

Another exemplary embodiment comprises a single neodymium (NdFeB) magnet 25 with a positive polarity and a strength in excess of 11,400 gauss. The minimum specifications of the neodymium magnets used are as follows: BH Max=~33-37, BR Gauss=~10,000-12,500, Hc Oersteds=~10,800 HCI Oersteds=~20,000, Maximum Operating Temperature=~302° F. The positive polarity applied to the fluid passageway 45 induces a magnetic flux on the fluid to perturb and decluster the exposed fluid molecules. The magnet 25 is supported by a housing 10 such that a north pole 30 of each one magnet 25 is adjacent the fluid passageway 45, and a south pole 35 of each magnet 25 is on an opposite side of the north pole 30 relative to the fluid passageway 45. This exemplary embodiment includes screw mechanisms 16 for maintaining the position of each magnet 25 relative to the feeding fuel line 20. The screw mechanisms 16 in this exemplary embodiment attach to a backing plate 15 adjacent the opposite side of the feeding fuel line 20 from the magnet 25, such that the feeding fuel line 20 runs between the housing 10 supporting the neodymium and the backing plate 15. One of skill in the art will appreciate that any other positive polarity magnetic-field-generating device having the aforementioned minimum specifications and disposed adjacent the feeding fuel line 20 may also be used. One of skill will further appreciate that more than one magnet 25, whether or not neodymium, can be located in a line array adjacent the fluid passageway 45 to achieve the foregoing minimum specifications. Alternate embodiments will include alternate other known means for positioning the assembly adjacent the fuel line. Such means, without limitation, may include straps or clamps, for example.

Figure 9:
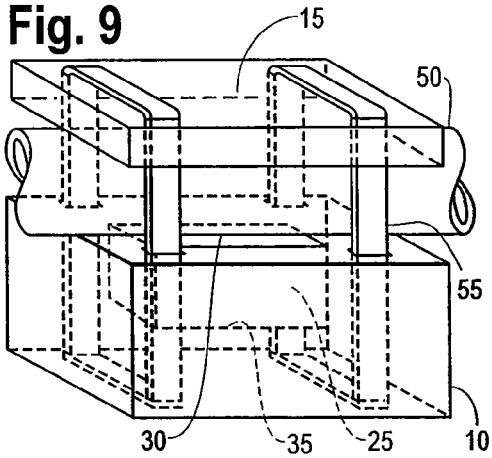
FIG. 9 illustrates a side view of an assembly comprising a housing attached to an air intake tube 50 according to an exemplary embodiment of the invention disclosed herein; and, FIG. 10 illustrates a side view of an assembly comprising the first housing and the second housing attached to an air intake tube 50 according to an exemplary embodiment of the invention disclosed herein.
Figure 10:
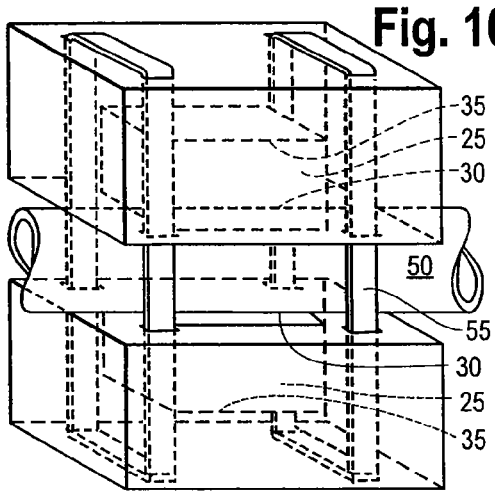

As shown in the exemplary embodiment depicted in FIGS. 5-8, more than one magnet assembly 5 may be used on opposite sides of a feeding fluid passageway 45, so long as both magnets have their positive poles adjacent the fluid passageway 45 and meet the foregoing minimum specifications. In an alternate embodiment, as shown in FIG. 9, one of the two magnet assemblies is additionally attached, using a strapping means 55, to be positioned at the combustion chamber air intake tube 50 so as to impart a negative charge on the air molecules. In this embodiment, one or two magnet assemblies 5 are also attached, each having a positive polarity adjacent the fluid passageway 45 as described above. In still another embodiment, as shown in FIG. 10, the air intake tube 50 is fitted with at least two magnet assemblies 5, each simultaneously imparting a negative charge on the air molecules.

Testing

Many have tried and failed to solve the problems associated with harmful emissions from internal combustion engines. Further, many have made unsubstantiated claims concerning emission reductions, increased gas mileage and improved horsepower. However, none of the units which have been tested by third party laboratories have shown significant improvement on any of these dimensions. Indeed, the Federal Trade Commission has stated:

> "Claims usually tout savings ranging from 12 to 25 percent. However, the Environmental Protection Agency (EPA) has evaluated or tested more than 100 alleged gas-saving devices and has not found any product that significantly improves gas mileage.

"Gas-Saving" Products: Fact or Fuelishness?, Federal Trade Commission, http://www.ftc.gov/bcp/edu/pubs/consumer/autos/aut10.shtm (accessed Sep. 21, 2007).

One reliable way to assess the impact of magnetic fields on hydrocarbon fuels is to test the exhaust emissions. The units tested previously (including some made from directions and instructions found on internet web sites) produced no improvements in reducing carbon monoxide, carbon dioxide or hydrocarbon exhaust emissions.

Exemplary embodiments of the present invention were tested for efficacy on a range of vehicles using various gas emissions analyzers. Analyzers used included the Kane-May SCA91 Single Gas Analyzer; the TSI Model #CA 600 Exhaust Gas Analyzer, which tested for carbon monoxide; and, the TESTO Model #335 Exhaust Gas Analyzer, which tested for carbon monoxide and oxygen. Further, independent tests conducted by the Environmental Protection Agency Vehicle Emissions Division of the State of Illinois and Raeco-LIC LLC were conducted on exemplary embodiments of the present invention.

Table 1 depicts gas analyzer carbon monoxide emissions reduction results on foreign and domestic vehicles spanning from the 1971 to 2003 model years.

TABLE 1

| Vehicle | CO Emission (ppm) | CO Emission With Assembly 5 (ppm) | % CO Reduction |
|---|---|---|---|
| 2003 Ford Escape V6 SUV | 3,890 | 0 | 100 |
| 1996 Buick Century V6 | 3,150 | 12 | 99 |
| 1996 Ford Taurus V6 | 2,940 | 15 | 99 |
| 1985 Oldsmobile Ninety-Eight V8 | 30,400 | 11 | 99 |
| 1971 Porsche 911 V6 | 40,200 | 780 | 98 |

As shown in Table 1, the application of an exemplary embodiment of the present invention to a feeding fuel line 20 resulted in carbon monoxide emission reductions of 98-100 percent at idle.

Utilizing one exemplary embodiment, third party independent testing by Raeco LIC, LLC of Frankfort, Ill. confirmed dramatically reduced carbon monoxide results from exhaust emissions at idle engine revolutions per minute. Testing results indicated that the embodiment reduced carbon monoxide levels to between zero and one parts per million, as tested using a TSI Model 6200 CA Calc gas emissions analyzer. The test was performed on Mar. 27, 2007 using a 2003 Ford Escape SUV 6-cylinder engine having approximately 75,000 miles of wear and tear. The baseline carbon monoxide levels without an exemplary embodiment of the invention installed was about 4,000 parts per million at idle. Three separate exemplarily embodiment tests were performed. The first two exemplarily embodiment tests showed zero parts per million of carbon monoxide emissions at idle engine revolutions per minute. The third exemplarily embodiment test showed a carbon monoxide level of Zero to one parts per million at idle engine revolutions per minute.

Finally, Independent testing by the Environmental Protection Agency Vehicle Emission Division of the State of Illinois also confirmed the dramatically reduced carbon monoxide results from exhaust emissions employing the exemplary embodiments of the present invention. The subject vehicle, a V6 1993 Ford Taurus (VIN 1FACP52U9PG331186), was driven on a dynamometer from zero to 40 miles per hour. Baseline and exemplary embodiment testing were performed using the same vehicle, using the same fuel, less than 75 minutes apart, at the same Illinois EPA facility, in the same testing lane using the same IM240 EPA testing equipment.

TABLE 2

| Illinois Before Seconds | EPA Before CO2 | Vehicle Before HC | Test Before CO | Illinois After Seconds | EPA After CO2 | Vehicle After HC | Test After CO |
|---|---|---|---|---|---|---|---|
| 0 | 0.00 | 0.00 | 0.00 | 0 | 0.00 | 0.00 | 0.00 |
| 1 | 1.08 | 0.0087 | 0.137 | 1 | 1.068 | 0.0058 | 0.024 |
| 2 | 1.126 | 0.0092 | 0.147 | 2 | 1.134 | 0.0058 | 0.019 |
| 3 | 1.16 | 0.0095 | 0.151 | 3 | 1.172 | 0.0052 | 0.012 |
| 4 | 1.531 | 0.0109 | 0.166 | 4 | 1.4 | 0.0043 | 0.008 |
| 5 | 2.276 | 0.013 | 0.187 | 5 | 2.057 | 0.0045 | 0.008 |
| 6 | 3.118 | 0.0124 | 0.154 | 6 | 2.531 | 0.0054 | 0.01 |
| 7 | 3.65 | 0.0114 | 0.093 | 7 | 3.175 | 0.0076 | 0.021 |
| 8 | 3.982 | 0.013 | 0.087 | 8 | 4.143 | 0.0103 | 0.038 |
| 9 | 4.555 | 0.0135 | 0.079 | 9 | 4.916 | 0.0138 | 0.091 |
| 10 | 4.833 | 0.014 | 0.085 | 10 | 4.968 | 0.0154 | 0.102 |
| 11 | 4.113 | 0.0122 | 0.053 | 11 | 4.126 | 0.014 | 0.074 |
| 12 | 3.244 | 0.0104 | 0.042 | 12 | 3.383 | 0.0116 | 0.054 |
| 13 | 3.531 | 0.0093 | 0.032 | 13 | 2.845 | 0.0093 | 0.035 |
| 14 | 3.814 | 0.0095 | 0.027 | 14 | 2.708 | 0.0085 | 0.027 |
| 15 | 3.753 | 0.0103 | 0.031 | 15 | 2.549 | 0.0086 | 0.026 |
| 16 | 2.564 | 0.0083 | 0.021 | 16 | 1.846 | 0.0078 | 0.028 |
| 17 | 1.628 | 0.006 | 0.014 | 17 | 1.36 | 0.006 | 0.02 |
| 18 | 1.186 | 0.0046 | 0.013 | 18 | 1.154 | 0.0043 | 0.011 |
| 19 | 1.046 | 0.0045 | 0.023 | 19 | 1.096 | 0.0039 | 0.013 |
| 20 | 1.052 | 0.0042 | 0.022 | 20 | 1.08 | 0.0042 | 0.017 |
| 21 | 1.027 | 0.0032 | 0.012 | 21 | 1.049 | 0.0039 | 0.01 |
| 22 | 1.016 | 0.0025 | 0.005 | 22 | 1.001 | 0.0029 | 0.005 |
| 23 | 1.418 | 0.0023 | 0.003 | 23 | 1.02 | 0.0023 | 0.003 |
| 25 | 1.74 | 0.0026 | 0.005 | 25 | 1.291 | 0.0021 | 0.003 |
| 26 | 2.843 | 0.0041 | 0.016 | 26 | 1.832 | 0.0025 | 0.004 |
| 27 | 3.372 | 0.0058 | 0.023 | 27 | 2.542 | 0.0038 | 0.008 |
| 28 | 3.515 | 0.008 | 0.029 | 28 | 3.133 | 0.0066 | 0.023 |
| 29 | 3.868 | 0.0092 | 0.03 | 29 | 3.567 | 0.0099 | 0.038 |
| 30 | 3.891 | 0.0105 | 0.038 | 30 | 3.925 | 0.0117 | 0.041 |
| 31 | 3.585 | 0.0094 | 0.027 | 31 | 3.688 | 0.0123 | 0.045 |
| 32 | 2.923 | 0.0085 | 0.02 | 32 | 3.025 | 0.0104 | 0.032 |
| 33 | 1.908 | 0.0061 | 0.011 | 33 | 2.256 | 0.0091 | 0.033 |
| 34 | 1.346 | 0.0047 | 0.011 | 34 | 1.647 | 0.0064 | 0.019 |
| 35 | 1.126 | 0.0042 | 0.017 | 35 | 1.278 | 0.0047 | 0.011 |
| 36 | 1.086 | 0.0033 | 0.012 | 36 | 1.125 | 0.004 | 0.012 |
| 37 | 1.046 | 0.0026 | 0.006 | 37 | 1.06 | 0.0033 | 0.011 |
| 38 | 1.494 | 0.0023 | 0.003 | 38 | 1.718 | 0.0029 | 0.006 |
| 39 | 2.884 | 0.0034 | 0.007 | 39 | 3.026 | 0.0041 | 0.008 |
| 40 | 3.708 | 0.0051 | 0.013 | 40 | 3.796 | 0.0075 | 0.022 |
| 41 | 4.194 | 0.0075 | 0.021 | 41 | 4.249 | 0.0102 | 0.035 |
| 42 | 4.912 | 0.0094 | 0.034 | 42 | 4.359 | 0.0114 | 0.045 |
| 43 | 5.076 | 0.0095 | 0.032 | 43 | 4.46 | 0.0118 | 0.044 |
| 44 | 4.373 | 0.0094 | 0.025 | 44 | 4.224 | 0.0119 | 0.041 |
| 45 | 3.651 | 0.0081 | 0.024 | 45 | 2.791 | 0.0087 | 0.026 |
| 46 | 2.434 | 0.0061 | 0.018 | 46 | 2.047 | 0.0068 | 0.022 |
| 47 | 1.304 | 0.0037 | 0.007 | 47 | 2.137 | 0.0064 | 0.026 |
| 48 | 1.934 | 0.0064 | 0.008 | 48 | 2.643 | 0.0057 | 0.019 |
| 49 | 3.821 | 0.0221 | 0.039 | 49 | 2.684 | 0.005 | 0.014 |
| 50 | 4.508 | 0.0147 | 0.032 | 50 | 2.547 | 0.0046 | 0.011 |
| 51 | 4.089 | 0.0104 | 0.026 | 51 | 2.59 | 0.0044 | 0.009 |
| 52 | 3.63 | 0.0078 | 0.021 | 52 | 3.012 | 0.0049 | 0.014 |
| 53 | 3.543 | 0.0064 | 0.018 | 53 | 3.231 | 0.0048 | 0.012 |
| 54 | 3.44 | 0.005 | 0.01 | 54 | 3.226 | 0.0049 | 0.011 |
| 55 | 3.326 | 0.005 | 0.01 | 55 | 2.71 | 0.0052 | 0.017 |
| 56 | 3.205 | 0.0048 | 0.011 | 56 | 2.117 | 0.0041 | 0.011 |
| 57 | 3.005 | 0.0045 | 0.01 | 57 | 1.418 | 0.0037 | 0.013 |
| 59 | 1.542 | 0.0026 | 0.003 | 59 | 2.708 | 0.02 | 0.025 |
| 60 | 2.499 | 0.0176 | 0.037 | 60 | 3.108 | 0.018 | 0.031 |
| 61 | 3.015 | 0.0175 | 0.057 | 61 | 3.057 | 0.0106 | 0.022 |
| 62 | 3.146 | 0.0103 | 0.029 | 62 | 2.902 | 0.0073 | 0.019 |
| 63 | 2.335 | 0.0065 | 0.017 | 63 | 2.839 | 0.0059 | 0.019 |
| 64 | 1.36 | 0.004 | 0.007 | 64 | 2.658 | 0.005 | 0.014 |
| 65 | 1.638 | 0.0068 | 0.006 | 65 | 2.651 | 0.0043 | 0.012 |
| 66 | 2.297 | 0.0291 | 0.052 | 66 | 2.642 | 0.0041 | 0.012 |
| 67 | 2.732 | 0.0194 | 0.054 | 67 | 2.676 | 0.0036 | 0.01 |
| 68 | 2.99 | 0.0107 | 0.022 | 68 | 2.702 | 0.0035 | 0.008 |
| 69 | 3.384 | 0.0072 | 0.015 | 69 | 2.689 | 0.0031 | 0.006 |
| 70 | 3.595 | 0.0054 | 0.011 | 70 | 2.661 | 0.003 | 0.006 |
| 71 | 3.25 | 0.0044 | 0.007 | 71 | 2.545 | 0.0027 | 0.005 |
| 72 | 2.528 | 0.0035 | 0.005 | 72 | 2.258 | 0.0026 | 0.005 |
| 73 | 1.556 | 0.0029 | 0.008 | 73 | 1.651 | 0.002 | 0.003 |
| 74 | 1.737 | 0.0039 | 0.012 | 74 | 1.286 | 0.0015 | 0.002 |
| 75 | 2.385 | 0.0123 | 0.028 | 75 | 1.786 | 0.0068 | 0.008 |
| 76 | 2.842 | 0.009 | 0.024 | 76 | 2.362 | 0.0154 | 0.027 |
| 77 | 2.994 | 0.0053 | 0.011 | 77 | 3.074 | 0.0096 | 0.019 |

TABLE 2-continued

| | | | | | | | |
|---|---|---|---|---|---|---|---|
| 78 | 3.09 | 0.0041 | 0.01 | 78 | 3.314 | 0.0062 | 0.014 |
| 79 | 3.099 | 0.0032 | 0.007 | 79 | 3.295 | 0.0055 | 0.02 |
| 80 | 3.126 | 0.0027 | 0.006 | 80 | 3.252 | 0.0043 | 0.014 |
| 81 | 3.043 | 0.0024 | 0.005 | 81 | 2.798 | 0.0042 | 0.014 |
| 82 | 1.977 | 0.002 | 0.004 | 82 | 1.453 | 0.0026 | 0.007 |
| 83 | 1.126 | 0.0015 | 0.002 | 83 | 0.999 | 0.0018 | 0.003 |
| 84 | 0.837 | 0.0012 | 0.001 | 84 | 1.014 | 0.0017 | 0.002 |
| 85 | 0.985 | 0.0039 | 0.001 | 85 | 1.084 | 0.0107 | 0.005 |
| 86 | 1.017 | 0.0226 | 0.023 | 86 | 1.03 | 0.0177 | 0.018 |
| 87 | 0.973 | 0.0214 | 0.055 | 87 | 1.012 | 0.0105 | 0.014 |
| 88 | 0.993 | 0.012 | 0.033 | 88 | 1.037 | 0.0057 | 0.006 |
| 89 | 1.034 | 0.0074 | 0.018 | 89 | 1.048 | 0.0037 | 0.004 |
| 90 | 1.028 | 0.0049 | 0.01 | 90 | 1.045 | 0.0028 | 0.003 |
| 91 | 1.017 | 0.0034 | 0.005 | 91 | 1.045 | 0.0023 | 0.002 |
| 93 | 1.027 | 0.0019 | 0.001 | 93 | 1.05 | 0.0014 | 0.001 |
| 94 | 1.03 | 0.0016 | 0.001 | 94 | 1.048 | 0.0012 | 0 |
| 95 | 1.034 | 0.0014 | 0.001 | 95 | 1.087 | 0.0011 | 0 |
| 96 | 1.299 | 0.0013 | 0.001 | 96 | 1.825 | 0.0011 | 0.001 |
| 97 | 2.064 | 0.0016 | 0.004 | 97 | 2.847 | 0.0019 | 0.006 |
| 98 | 2.876 | 0.002 | 0.01 | 98 | 3.111 | 0.0024 | 0.007 |
| 99 | 3.335 | 0.0022 | 0.009 | 99 | 3.21 | 0.0025 | 0.006 |
| 100 | 4.109 | 0.0025 | 0.015 | 100 | 3.666 | 0.0033 | 0.019 |
| 101 | 5.332 | 0.0044 | 0.061 | 101 | 4.523 | 0.004 | 0.031 |
| 102 | 5.783 | 0.0045 | 0.054 | 102 | 5.242 | 0.004 | 0.021 |
| 103 | 5.597 | 0.0041 | 0.027 | 103 | 5.484 | 0.004 | 0.014 |
| 104 | 5.066 | 0.0032 | 0.013 | 104 | 5.442 | 0.0039 | 0.013 |
| 105 | 4.702 | 0.0027 | 0.008 | 105 | 5.41 | 0.0039 | 0.014 |
| 106 | 4.363 | 0.0026 | 0.008 | 106 | 4.65 | 0.0036 | 0.012 |
| 107 | 3.153 | 0.0021 | 0.006 | 107 | 2.586 | 0.0026 | 0.009 |
| 108 | 1.66 | 0.0016 | 0.004 | 108 | 1.418 | 0.0016 | 0.005 |
| 109 | 1.071 | 0.0012 | 0.002 | 109 | 1.007 | 0.0011 | 0.002 |
| 110 | 1.403 | 0.0042 | 0.004 | 110 | 1.075 | 0.0016 | 0.002 |
| 111 | 2.503 | 0.019 | 0.049 | 111 | 1.872 | 0.0166 | 0.013 |
| 112 | 2.755 | 0.012 | 0.044 | 112 | 2.267 | 0.0144 | 0.019 |
| 113 | 1.651 | 0.0059 | 0.017 | 113 | 1.773 | 0.0068 | 0.009 |
| 114 | 1.048 | 0.0032 | 0.006 | 114 | 1.058 | 0.0033 | 0.004 |
| 115 | 1.004 | 0.0023 | 0.003 | 115 | 0.854 | 0.002 | 0.002 |
| 116 | 1.105 | 0.0084 | 0.009 | 116 | 0.98 | 0.0026 | 0.002 |
| 117 | 1.077 | 0.0133 | 0.028 | 117 | 1.372 | 0.0111 | 0.012 |
| 118 | 1.092 | 0.0079 | 0.02 | 118 | 1.548 | 0.0102 | 0.019 |
| 119 | 1.782 | 0.0048 | 0.009 | 119 | 1.306 | 0.0048 | 0.008 |
| 120 | 2.999 | 0.0038 | 0.013 | 120 | 1.232 | 0.0028 | 0.004 |
| 121 | 3.658 | 0.0034 | 0.014 | 121 | 1.636 | 0.0024 | 0.009 |
| 122 | 3.829 | 0.0032 | 0.014 | 122 | 2.26 | 0.002 | 0.009 |
| 123 | 3.239 | 0.0024 | 0.007 | 123 | 2.698 | 0.0023 | 0.021 |
| 124 | 2.294 | 0.002 | 0.006 | 124 | 2.835 | 0.0021 | 0.019 |
| 125 | 1.718 | 0.0016 | 0.007 | 125 | 2.912 | 0.0018 | 0.01 |
| 127 | 1.604 | 0.0011 | 0.002 | 127 | 2.197 | 0.0014 | 0.007 |
| 128 | 1.286 | 0.0009 | 0.001 | 128 | 1.584 | 0.001 | 0.003 |
| 129 | 1.156 | 0.0008 | 0.001 | 129 | 1.234 | 0.0009 | 0.006 |
| 130 | 1.12 | 0.0008 | 0.002 | 130 | 1.101 | 0.0009 | 0.009 |
| 131 | 1.11 | 0.0008 | 0.002 | 131 | 1.054 | 0.0009 | 0.008 |
| 132 | 1.097 | 0.0007 | 0.001 | 132 | 1.046 | 0.0007 | 0.004 |
| 133 | 1.111 | 0.0006 | 0.001 | 133 | 1.052 | 0.0005 | 0.002 |
| 134 | 1.209 | 0.0006 | 0 | 134 | 1.148 | 0.0005 | 0.001 |
| 135 | 2.355 | 0.0007 | 0 | 135 | 1.794 | 0.0005 | 0.001 |
| 136 | 3.665 | 0.0009 | 0.001 | 136 | 2.861 | 0.0007 | 0.001 |
| 137 | 4.575 | 0.0018 | 0.006 | 137 | 3.262 | 0.0014 | 0.009 |
| 138 | 4.984 | 0.0023 | 0.009 | 138 | 3.434 | 0.0018 | 0.015 |
| 139 | 4.827 | 0.0021 | 0.005 | 139 | 3.524 | 0.0016 | 0.1 |
| 140 | 3.55 | 0.0017 | 0.004 | 140 | 3.811 | 0.0016 | 0.009 |
| 141 | 2.588 | 0.0013 | 0.004 | 141 | 3.548 | 0.0015 | 0.01 |
| 142 | 1.911 | 0.0012 | 0.008 | 142 | 2.973 | 0.0015 | 0.011 |
| 143 | 2.097 | 0.0009 | 0.005 | 143 | 2.457 | 0.0013 | 0.013 |
| 144 | 2.326 | 0.0008 | 0.002 | 144 | 1.509 | 0.0008 | 0.007 |
| 145 | 2.432 | 0.0008 | 0.002 | 145 | 1.106 | 0.0005 | 0.002 |
| 146 | 2.511 | 0.0007 | 0.002 | 146 | 1.705 | 0.0043 | 0.008 |
| 147 | 2.379 | 0.0007 | 0.002 | 147 | 2.607 | 0.0092 | 0.028 |
| 148 | 1.727 | 0.0006 | 0.001 | 148 | 3.018 | 0.0051 | 0.017 |
| 149 | 1.605 | 0.0007 | 0.002 | 149 | 2.701 | 0.0032 | 0.013 |
| 150 | 2.126 | 0.0034 | 0.02 | 150 | 2.424 | 0.002 | 0.008 |
| 151 | 2.368 | 0.0029 | 0.022 | 151 | 2.223 | 0.0014 | 0.006 |
| 152 | 2.481 | 0.0016 | 0.009 | 152 | 2.197 | 0.0009 | 0.003 |
| 153 | 2.512 | 0.0011 | 0.004 | 153 | 2.202 | 0.0007 | 0.002 |
| 154 | 1.885 | 0.0008 | 0.002 | 154 | 2.207 | 0.0005 | 0.001 |
| 155 | 1.348 | 0.0007 | 0.002 | 155 | 2.668 | 0.0006 | 0.002 |
| 156 | 2.082 | 0.0058 | 0.021 | 156 | 3.635 | 0.0013 | 0.017 |
| 157 | 3.548 | 0.0106 | 0.065 | 157 | 4.426 | 0.0016 | 0.016 |
| 158 | 5.639 | 0.0064 | 0.04 | 158 | 4.971 | 0.002 | 0.013 |
| 159 | 7.128 | 0.0055 | 0.04 | 159 | 5.443 | 0.0025 | 0.011 |
| 160 | 7.705 | 0.0052 | 0.047 | 160 | 6.026 | 0.003 | 0.013 |
| 161 | 8.07 | 0.0047 | 0.026 | 161 | 7.159 | 0.0035 | 0.011 |
| 162 | 8.333 | 0.0051 | 0.036 | 162 | 7.421 | 0.004 | 0.015 |
| 163 | 8.461 | 0.0049 | 0.034 | 163 | 6.924 | 0.0038 | 0.018 |
| Totals | 432.22 | 0.93 | 3.69 | Totals | 404.75 | 0.79 | 2.45 |

Percentage Decrease of each pollutant

| | |
|---|---|
| CO2 = Carbon Dioxide | 6.35% Decrease |
| HC = Hydro Carbons | 15.05% Decrease |
| CO = Carbon Monoxide | 33.60% Decrease |

As shown in Table 2, from idle to approximately 40 mph, exemplary embodiments (compared to baseline testing on the same vehicle) reduced aggregate carbon monoxide, hydrocarbon and carbon dioxide combustion emissions levels by approximately 33.60%, 15.05% and 6.35%, respectively. Even accounting for up to a 20% variable outcome between test results due to potentially confounding variables such as cold starts, engine maintenance and acceleration patterns, a net minimum reduction of 26.88% in carbon monoxide emissions at 0-40 mph is unquestionably a dramatic reduction of greenhouse effect emissions. Additionally, those skilled in the art will recognize that the reductions in carbon monoxide, hydrocarbon, and carbon dioxide emissions indicate that the fuel is combusting more efficiently in the engine, and that improved fuel mileage can be expected.

Figure 11:
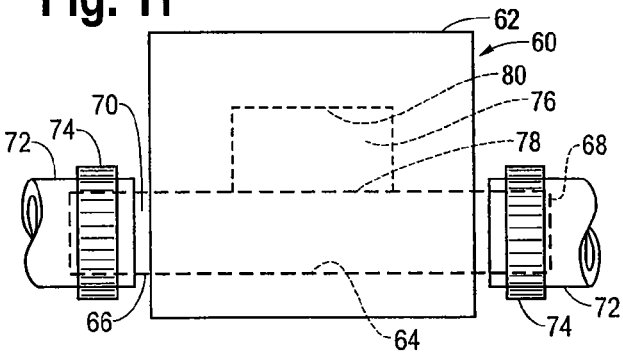
FIG. 11 is a schematic perspective side view of a cartridge-like single magnet element embodiment of the present invention, shown inserted and clamped into a spliced fuel line.
Figure 12:
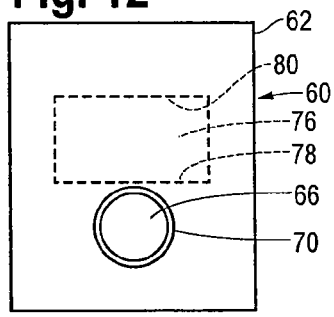
FIG. 12 is a perspective front view of the cartridge-like embodiment of FIG. 11.

Further embodiments of the present invention are shown in FIGS. 11-14, with each of these embodiments providing a cartridge-type assembly adapted to be readily inserted or spliced into an existing fuel line leading to a combustion chamber. In the embodiment of FIGS. 11 and 12, a cartridge-like assembly 60 comprises a housing 62 having a channel 64 extending through the housing. A hollow tube 66 is mounted in channel 64, with portions 68 and 70 of tube 66 extending outward from both sides of housing 62. In the illustrated embodiment, the outer diameters of portions 68 and 70 of tube 66 are slightly less than the inner diameter of fuel line 72. When cartridge-like assembly 60 is attached to fuel line 72, as shown in FIG. 11, the outer ends of tube portions 68 and 70 are inserted into the hollow portion of fuel line 72. The fuel line 72 has previously been cut at a predetermined location to accommodate the insertion of tube portions 68 and 70 into the respective sections of fuel line 72, as seen in FIG. 11. After portions 68 and 70 have been inserted into the fuel line, a pair of clamps 74 are tightened around the outside diameter of fuel line 72 adjacent the cut ends, and the clamps 74 are tightened until tube portions 68 and 70 are tightly held in fuel line 72, whereby fluid leakage is prevented. In this manner, hollow tube 66 becomes part of fuel line 72 and accommodates the passage of fuel from the fuel source or tank to the combustion chamber.

In the embodiment of FIGS. 11 and 12, a magnetic element 76 is mounted, either permanently or removeably, inside housing 62. The north pole 78 of the magnetic element 76 is disposed against hollow tube 66, and south pole 80 of magnetic element 76 is disposed away from hollow tube 66. In this manner, the fuel molecules in fuel line 66 only receive a single pole magnetization, which tends to have the molecules in a cluster repel one another, thus tending to break up and disperse the previously clustered fuel molecules.

Figure 13:
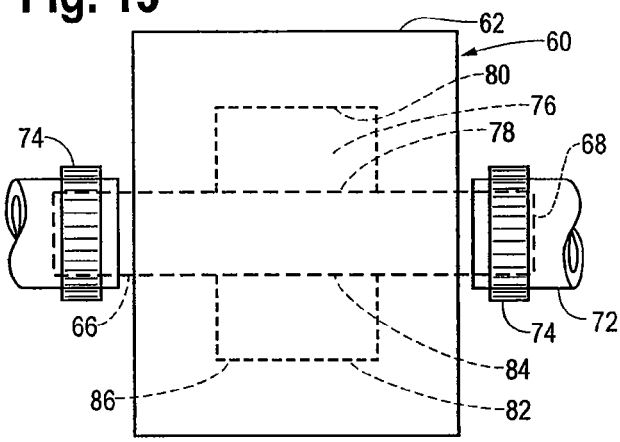
FIG. 13 is a schematic perspective side view of a cartridge-like multiple magnet element embodiment of the present invention, shown inserted and clamped into a spliced fuel line.
Figure 14:
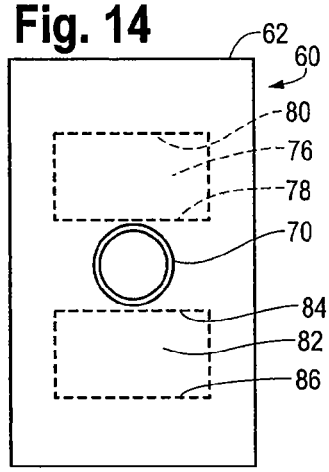
FIG. 14 is a perspective front view of the cartridge-like embodiment of FIG. 13.

The embodiment of the present invention shown in FIGS. 13 and 14 is similar to the embodiment of FIGS. 11 and 12, with the exception that cartridge-like assembly 60 includes a first magnetic element 76 and a second magnetic element 82 having a north pole 84 disposed adjacent tube 66, and a south pole 86 facing away from tube 66. The second magnetic element 82 augments the single polarity exposure of the fuel molecules compared to the embodiment of FIGS. 11 and 12. In other respects, the structure, assembly and operation of the embodiments of FIGS. 11, 12 and FIGS. 13, 14 are substantially the same.

Figure 15:
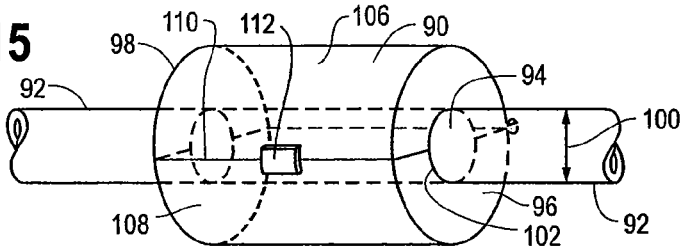
FIG. 15 is a schematic perspective side view of a cylindrical embodiment of the present invention, shown installed over a typical fuel line.

An additional embodiment of the present invention is shown in FIG. 15. In this embodiment, housing 90 is cylindrical in shape and made of magnetized material. Hollow tube 92, constituting a fuel line, extends through channel 94 in housing 90, and extends beyond the side ends 96 and 98 of housing 90. The entire length of inner diameter 100 of housing 90 comprises the north pole 102 of the magnetized material, and the outer diameter of housing 90 comprises the south pole 104 of the magnetized material of housing 90. The fuel passing through channel 94 is subject to only single pole magnetization, providing the fuel molecules with a force tending to separate the fuel molecules in tube 92 that were previously formed in clusters.

In an embodiment, housing 90 can be formed from a single piece of cylindrical magnetizable material, with the core drilled out to form channel 94 having inner diameter 100. This type of structure is adapted to be installed by OEM's during the manufacture of internal combustion engines, where fuel line or tube 92 is inserted through channel 94 prior to connecting the outer ends of the fuel line to the fuel tank and the fuel intake assembly of the internal combustion apparatus to be supplied by the fuel line 92. This embodiment is equally adoptable for use in retrofitting existing engine fuel delivery systems.

In a further embodiment, referring to FIG. 15, the housing 90 is formed in two parts, 106 and 108, that are removably joined together along a split line 110. In an embodiment, one side of parts 106 and 108 can be pivotally joined by a hinge (not shown), and the two parts 106 and 108 are held together when joined, as seen in FIG. 15, by a suitable latch mechanism 112. If desired, the hinge can be replaced by a second suitable latch mechanism.

The embodiment of FIG. 15 having the two part configuration is suitable for aftermarket assembly of the present invention to existing internal combustion systems, as well as newly manufactured fuel systems. By initially separating the two parts 106 and 108, the housing 90 can be placed over an existing fuel line tube 92. The two parts 106 and 108 are then clamped or latched together as is known in the art, exposing the fuel in tube 92 to only the single polarity magnetism of inner diameter 100 of housing 90. In this manner, the fuel line tube 92 does not have to be disconnected from either the fuel tank or reservoir, or from the fuel intake assembly of the internal combustion apparatus.

While the description above refers to particular exemplary embodiments of the assemblies disclosed herein, it should be understood that many modifications might be made without departing from the spirit thereof. The accompanying international summary is intended to cover such modifications as would fall within the true scope and spirit of the apparatus and process disclosed herein. The presently disclosed exemplary embodiments are therefore to be considered in all respects illustrative and not restrictive, the scope of the exemplary assembly 5 embodiments disclosed herein being indicated by the summary, rather than the foregoing description, and all changes that come within the meaning and range of equivalency of the summary is therefore, intended to be embraced therein.

The invention claimed is:

1. An assembly for reducing combustion emissions of a combustion apparatus having a chamber producing combustion and a fluid passageway for carrying treated fluid to said chamber, said assembly comprising:

at least one magnet positioned such that only a north pole of said at least one magnet and any additional magnets adjacent said fluid passageway and a south pole of said at least one magnet and any additional magnets on an opposite side of said north pole, said south pole located at a position away from said fluid passageway, said at least one magnet capable of operating at a sustained efficiency at operating temperatures of approximately 302° F.;

said at least one magnet adapted to impart only a single positive polarity magnetic charge to fluid molecules in said fluid passageway;

at least one housing supporting said at least one magnet adjacent said fluid passageway, said at least one magnet providing a residual flux density of at least approximately 10,000 gauss;

said combustion emissions having at least approximately a 1.5% reduction in carbon dioxide emissions compared to said combustion production of untreated fluid.

2. The assembly of claim 1, wherein said at least one magnet directly abuts said fluid passageway.

3. An assembly for reducing combustion emissions of a combustion apparatus having a chamber producing combustion and a fluid passageway for carrying treated fluid to said chamber, said assembly comprising:

at least one magnet positioned such that only a north pole of said at least one magnet and any additional magnets adjacent said fluid passageway and a south pole of said at least one magnet and any additional magnets on an opposite side of said north pole, said south pole located at a position away from said fluid passageway, said at least one magnet capable of operating at a sustained efficiency at operating temperatures of approximately 302° F.;

said at least one magnet adapted to impart only a single positive polarity magnetic charge to fluid molecules in said fluid passageway;

at least one housing supporting said at least one magnet adjacent said fluid passageway, said at least one magnet providing a residual flux density of at least approximately 10,000 gauss;

said combustion emissions having at least approximately a 1.5% reduction in hydrocarbon emissions compared to said combustion production of untreated fluid.

4. The assembly of claim 3, wherein said at least one magnet directly abuts said fluid passageway.

5. An assembly for reducing combustion emissions of a combustion apparatus having a chamber producing combustion and a fluid passageway for carrying treated fluid to said chamber, said assembly comprising:

at least one magnet positioned such that only a north pole of said at least one magnet and any additional magnets adjacent said fluid passageway and a south pole of said at least one magnet and any additional magnets on an opposite side of said north pole, said south pole located at a position away from said fluid passageway, said at least one magnet capable of operating at a sustained efficiency at operating temperatures of approximately 302° F.;

said at least one magnet adapted to impart only a single positive polarity magnetic charge to fluid molecules in said fluid passageway;

at least one housing supporting said at least one magnet adjacent said fluid passageway, said at least one magnet providing a residual flux density of at least approximately 10,000 gauss;

said combustion emissions having at least approximately a 1.5% reduction in carbon monoxide compared to said combustion production of untreated fluid.

6. The assembly of claim 5, wherein said at least one magnet directly abuts said fluid passageway.

7. A process for treating, separating and dispersing fuel molecules in a fluid passageway communicating with a combustion apparatus having a chamber for producing combustion, said molecules in a cluster in said fluid passageway, comprising the steps of:

positioning only a north pole of at least one first magnet and any additional magnets adjacent said fluid passageway comprising said fuel molecules, positioning a south pole of said at least one first magnet and any additional magnets away from said fuel molecules, said fuel molecules being exposed only to and magnetized by a positive polarity magnetic force generated by only said north pole of said at least one first magnet, said fuel molecules repelling one another as a result of said single pole positive polarity magnetization of each molecule;

said combustion apparatus producing combustion emissions having at least approximately a 1.5% reduction in hydrocarbon emissions compared to said combustion production of untreated fuel molecules.

8. The process of claim 7, wherein said at least one first magnet provides a residual flux density of at least approximately 10,000 gauss.

9. The process of claim 8, wherein said at least one first magnet is capable of operating at a sustained efficiency at operating temperatures of approximately 302° F.

10. The process of claim 9, wherein said at least one first magnet directly abuts said fluid passageway.

11. A process for treating, separating and dispersing fuel molecules in a fluid passageway communicating with a combustion apparatus having a chamber for producing combustion, said molecules in a cluster in said fluid passageway, comprising the steps of:

positioning only a north pole of at least one first magnet and any additional magnets adjacent said fluid passageway comprising said fuel molecules;

positioning a south pole of said at least one first magnet and any additional magnets away from said fuel molecules, said fuel molecules being exposed only to and magnetized by a positive polarity magnetic force generated by only said north pole of said at least one first magnet, said fuel molecules repelling one another as a result of said single pole positive polarity magnetization of each molecule;

said combustion apparatus producing combustion emissions having at least approximately a 1.5% reduction in carbon dioxide emissions compared to said combustion production of untreated fuel molecules.

12. The process of claim 11, wherein said at east one first magnet provides a residual flux density of at least approximately 10,000 gauss.

13. The process of claim 12, wherein said at least one first magnet is capable of operating at a sustained efficiency at operating temperatures of approximately 302° F.

14. The process of claim 13, wherein said at least one first magnet directly abuts said fluid passageway.

15. A process for treating, separating and dispersing fuel molecules in a fluid passageway communicating with a combustion apparatus having a chamber for producing combustion, said molecules in a cluster in said fluid passageway, comprising the steps of:

positioning only a north pole of at least one first magnet and any additional magnets adjacent said fluid passageway comprising said fuel molecules;

positioning a south pole of said at least one first magnet and any additional magnets away from said fuel molecules, said fuel molecules being exposed only to and magnetized by a positive polarity magnetic force generated by only said north pole of said at least one first magnet, said fuel molecules repelling one another as a result of said single pole positive pole magnetization of each molecule;

said combustion apparatus producing combustion emissions having at least approximately a 1.5% reduction in carbon monoxide emissions compared to said combustion production of untreated fuel molecules.

16. The process of claim 15, wherein said at least one first magnet provides a residual flux density of at least approximately 10,000 gauss.

17. The process of claim 16, wherein said at least one first magnet is capable of operating at a sustained efficiency at operating temperatures of approximately 302° F.

18. The process of claim 17, wherein said at least one first magnet directly abuts said fluid passageway.

* * * * *